US011118546B2

(12) United States Patent
Yoshida et al.

(10) Patent No.: US 11,118,546 B2
(45) Date of Patent: Sep. 14, 2021

(54) ENGINE INTAKE SYSTEM

(71) Applicant: Mazda Motor Corporation, Hiroshima (JP)

(72) Inventors: Ken Yoshida, Hiroshima (JP); Masahiko Tanisho, Hiroshima (JP); Nozomu Hachiya, Aki-gun (JP); Kouichi Shimizu, Higashihiroshima (JP); Manabu Sugimoto, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/640,883

(22) PCT Filed: Aug. 25, 2017

(86) PCT No.: PCT/JP2017/030582
§ 371 (c)(1),
(2) Date: Feb. 21, 2020

(87) PCT Pub. No.: WO2019/038920
PCT Pub. Date: Feb. 28, 2019

(65) Prior Publication Data

US 2020/0355147 A1 Nov. 12, 2020

(51) Int. Cl.
*F02B 7/00* (2006.01)
*F02M 35/10* (2006.01)
(Continued)

(52) U.S. Cl.
CPC ..... *F02M 35/10222* (2013.01); *F02D 9/08* (2013.01); *F02D 41/0077* (2013.01);
(Continued)

(58) Field of Classification Search
CPC ..... F02D 23/00; F02D 41/0077; F02D 9/08; F02D 9/10; F02M 26/14; F02M 26/17
See application file for complete search history.

(56) References Cited

U.S. PATENT DOCUMENTS 4,924,840 A 5/1990 Wade
2019/0063376 A1* 2/2019 Ebesu ..... F02B 29/04
(Continued)

FOREIGN PATENT DOCUMENTS

CN 201891532 U 7/2011
DE 19858771 A1 7/1999
(Continued)

*Primary Examiner* — John Kwon
(74) *Attorney, Agent, or Firm* — Alleman Hall Creasman & Tuttle LLP

(57) ABSTRACT

An intake passage includes: a main intake passage provided with a throttle valve and extending from one side toward the other side along a cylinder bank; and a bypass passage provided with an EGR valve and connected to a part of the main intake passage located toward the other side with respect to the throttle valve. The bypass passage extends from a branch of the main intake passage toward the one side and then turns back and extends toward the other side. The EGR valve is located in a part of the bypass passage extending toward the other side and overlapping with a part extending from the branch to the one side.

17 Claims, 13 Drawing Sheets

(51) Int. Cl.

| | |
|---|---|
| ***F02M 26/14*** | (2016.01) |
| ***F02M 26/17*** | (2016.01) |
| ***F02D 9/08*** | (2006.01) |
| ***F02D 41/00*** | (2006.01) |

(52) U.S. Cl.
CPC ..... *F02M 26/14* (2016.02); *F02M 26/17* (2016.02); *F02M 35/10078* (2013.01); *F02M 35/10157* (2013.01); *F02M 35/10255* (2013.01)

(56) References Cited

U.S. PATENT DOCUMENTS

| | | | | |
|---|---|---|---|---|
| 2020/0347806 | A1* | 11/2020 | Tanisho | F02M 35/10216 |
| 2020/0370468 | A1* | 11/2020 | Shimizu | F02D 23/00 |

FOREIGN PATENT DOCUMENTS

| | | | |
|---|---|---|---|
| EP | 0809012 | A2 | 11/1997 |
| EP | 3171011 | A1 | 5/2017 |
| JP | S54122217 | A | 2/1978 |
| JP | S54122217 | U | 2/1978 |
| JP | A56027016 | A | 3/1981 |
| JP | S58111347 | U | 7/1983 |
| JP | H02233816 | A | 9/1990 |
| JP | H1030504 | A | 2/1998 |
| JP | H10213019 | A | 8/1998 |
| JP | 2006336539 | A | 12/2006 |
| JP | 2011001886 | A | 1/2011 |
| JP | 2016166593 | A | 9/2016 |

* cited by examiner

IN SUPERCHARGING

IN NATURAL ASPIRATION

ENGINE INTAKE SYSTEM

TECHNICAL FIELD

The technique disclosed herein relates to an intake system for an engine.

BACKGROUND ART

Patent Document 1 discloses an example of an intake system for an engine. Specifically, Patent Document 1 describes a structure of an intake passage for an internal combustion engine including: an intake passage connected to an internal combustion chamber; and a throttle valve (i.e., a first intake throttle valve) in the intake passage. The intake passage is connected to a second passage section (i.e., a detour) configured to have a predetermined second valve (i.e., an open/close valve for a flow path).

CITATION LIST

Patent Document

Patent Document 1: Japanese Unexamined Patent Publication No. 2011-1886

SUMMARY OF THE INVENTION

Technical Problem

The part of the intake passage provided with the throttle valve is referred to as a first passage section. In the engine as described in Patent Document 1, at least a part of each passage may extend from one side toward the other along a cylinder bank so that the first and second passage sections are substantially parallel to each other in view of, for example, providing reliable layout.

As described in Patent Document 1, however, not only the first passage section but also the second passage section may also include a valve (i.e., a second valve). Here, depending on the specific configuration of the engine or the required performance, the second valve may be disposed in the extension along the cylinder bank. In recent years, there is an increasing demand for arranging the throttle valve and the second valve as close as possible in view of downsizing of such an engine.

As a result of strenuous studies, the present inventors have found a more compact structure.

The present disclosure was made in view of the problem. It is an objective of the present disclosure to provide a more compact intake system for an engine including a second passage section and a second valve.

Solution to the Problem

The technique disclosed herein relates to an intake system for an engine including: an intake passage connected to a combustion chamber; and a throttle valve in the intake passage.

The intake passage includes: a first passage section provided with the throttle valve and extending from one side to the other side along a predetermined direction; and a second passage section provided with a specified second valve and connected to a part of the first passage section located toward the other side with respect to the throttle valve.

The second passage section extends from a connecting point between the first and second passage sections toward the one side and then turns back and extends from the one side toward the other side.

The second valve is located in a part of the second passage section extending toward the other side and overlapping, in the predetermined direction, with a part of the second passage section extending from the connecting point to the one side.

According to this configuration, the second passage section extends once from the point connected to the throttle valve toward the one side in the predetermined direction and then turns back and extends from the one side toward the other side. In this configuration, in view of the relative positional relationship between the connecting point and the throttle valve, the overlapping part, of the second passage section extending toward the other side, with the part of the second passage section extending toward the one side is closer to the throttle valve in the predetermined direction. The placement of the second valve in such a part allows a close arrangement between the second valve and the throttle valve in the predetermined direction, while arranging the second valve in the part extending toward the other side.

This allows an as close as possible arrangement between the throttle valve and the second valve in the intake system for the engine, which leads to achievement in a more compact engine.

The second passage may include: a joint passage section connected to the first passage section and extending from the other side toward the one side with an increasing distance from the connecting point; and a parallel passage section connected to an end of the joint passage section on the one side and extending toward the other side, and the joint passage section may be configured such that a center axis of the joint passage section is at acute angles from both a center axis of the first passage section and a center axis of the parallel passage section.

The "central axis" of each section used herein may extend along the center of the section in a geometrical sense (e.g., perpendicularly to the center of the section in the cross section) or along the main flow of gas. The term "central axis" is used in a broad sense.

This configuration allows an as close as possible arrangement between the throttle valve and the second valve in the intake system for the engine, which is eventually advantageous in achieving a more compact engine.

A supercharger may be disposed downstream of the throttle valve in the first passage section, and the connecting point between the first and second passage sections may be located between the throttle valve and a gas suction port of the supercharger in the predetermined direction.

The second valve may be located between the throttle valve and the supercharger in the predetermined direction.

In placement of the supercharger, an as short as possible flow path is required from the throttle valve to the suction port of the supercharger to improve the responsiveness of the gas. In order to satisfy such a demand, the layout of the intake system needs to be devised to arrange the supercharger and the throttle valve closer to each other. To achieve such a configuration, it is required to reduce the interference between the second valve and the supercharger.

According to this configuration, the second valve can be located between the throttle valve and the supercharger in the predetermined direction. This arrangement is advantageous in preventing the interference between the second valve and the supercharger.

In other words, in the configuration described above, the throttle valve and the second valve can be arranged as close as possible. This reduces the interference between the supercharger and the second valve in arranging the throttle valve and the supercharger close to each other. Accordingly, the flow path from the throttle valve to the suction port of the supercharger becomes shorter, which leads to an improvement in the responsiveness of the gas.

The system may further include an EGR passage connected to: an exhaust passage connected to the combustion chamber; and the intake passage, and the EGR passage may be connected to the second passage section of the intake passage, and the second valve may serve as an EGR valve for adjusting a backflow rate of gas passing through the EGR passage.

The second valve may be located at an end of the second passage section toward the one side.

If the external EGR gas is utilized to operate the engine, an as short as possible length of the flow path is required from the throttle valve to the EGR valve to improve the responsiveness of the gas.

By contrast, the configuration described above allows an as close as possible arrangement between the throttle valve and the second valve that serves as the EGR valve. This provides an as short as possible flow path from the throttle valve to the EGR valve, which leads to an improvement in the responsiveness of the gas.

In particular, if the supercharger is disposed in the first passage section as described above in the configuration in which the second valve is the EGR valve, it is possible to guide the gas to the combustion chamber, for example, through the first passage section in supercharging and through the second passage section in natural aspiration.

The second passage section may be located above the first passage section.

As described above, the second passage section is connected to the EGR passage. Accordingly, as compared to the configuration where the second passage section is located below the first passage section, condensed water contained in the external EGR gas can be smoothly guided to the combustion chamber.

Another technique disclosed herein relates to an intake system for an engine including: an intake passage connected to a combustion chamber; and a throttle valve and a supercharger in the intake passage.

The intake passage includes: a first passage section provided with the throttle valve and extending from one side toward the other side in a horizontal direction; a second passage section branching off from downstream of the throttle valve in the first passage section, extending from the other side toward the one side, and then turning back and extending from the one side toward the other side; and a predetermined second valve in the second passage section.

The second passage section is located above the first passage section in a vertical direction of a vehicle, and the second valve is located between the throttle valve and the supercharger in the horizontal direction.

A part of the second passage section extending from the other side toward the one side passes through a gap in the vertical direction between the first passage section and the second valve.

The term "horizontal" used herein represents the direction along a horizontal plane.

This configuration allows, in the intake system for the engine, an as close as possible arrangement between the throttle valve and the second valve in the horizontal direction, which leads to a more compact configuration.

Advantages of the Invention

As described above, the intake system for the engine described above has a more compact configuration.

DESCRIPTION OF EMBODIMENTS

Figure 1:
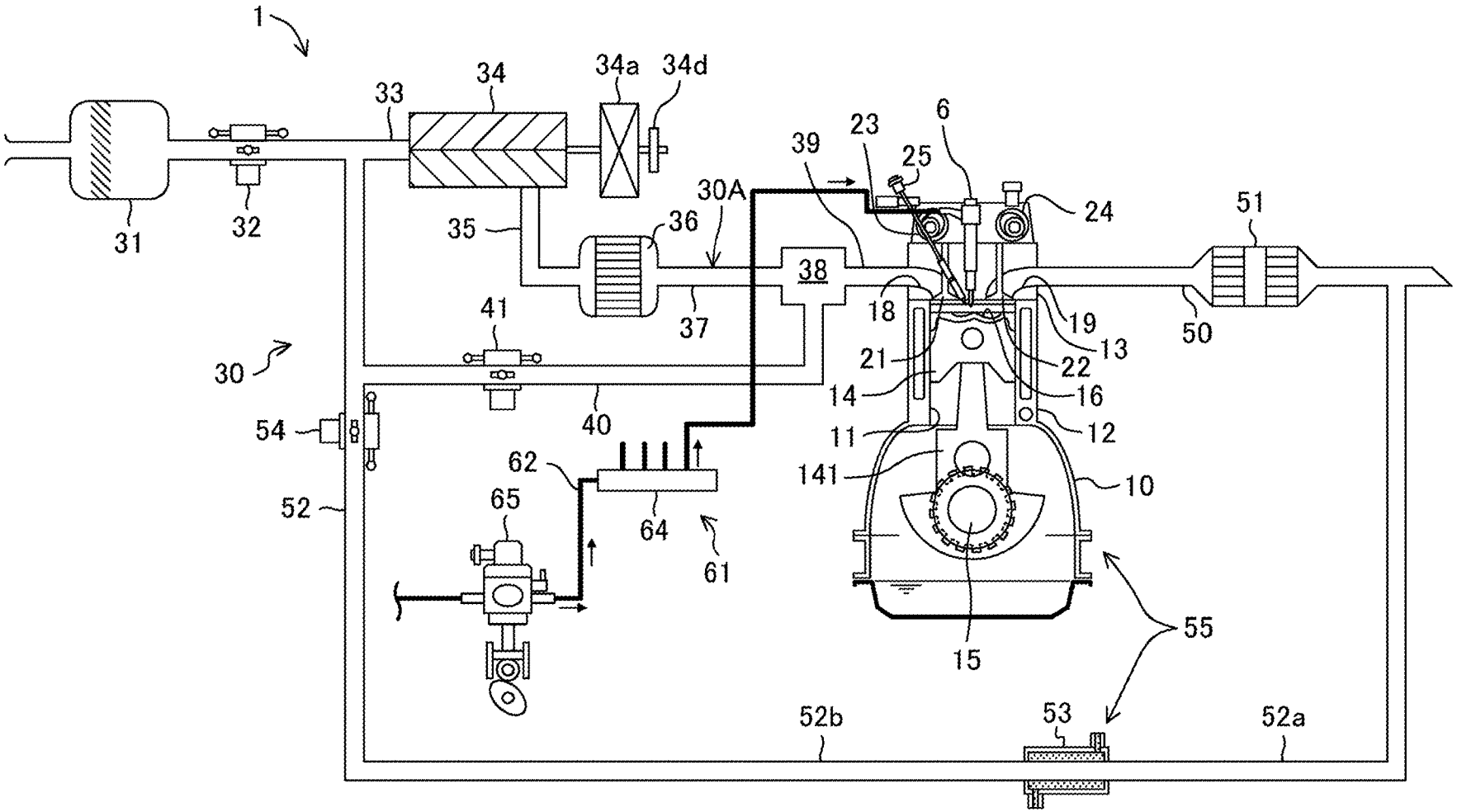
FIG. 1 is a schematic view illustrating an example configuration of an engine.
Figure 2:
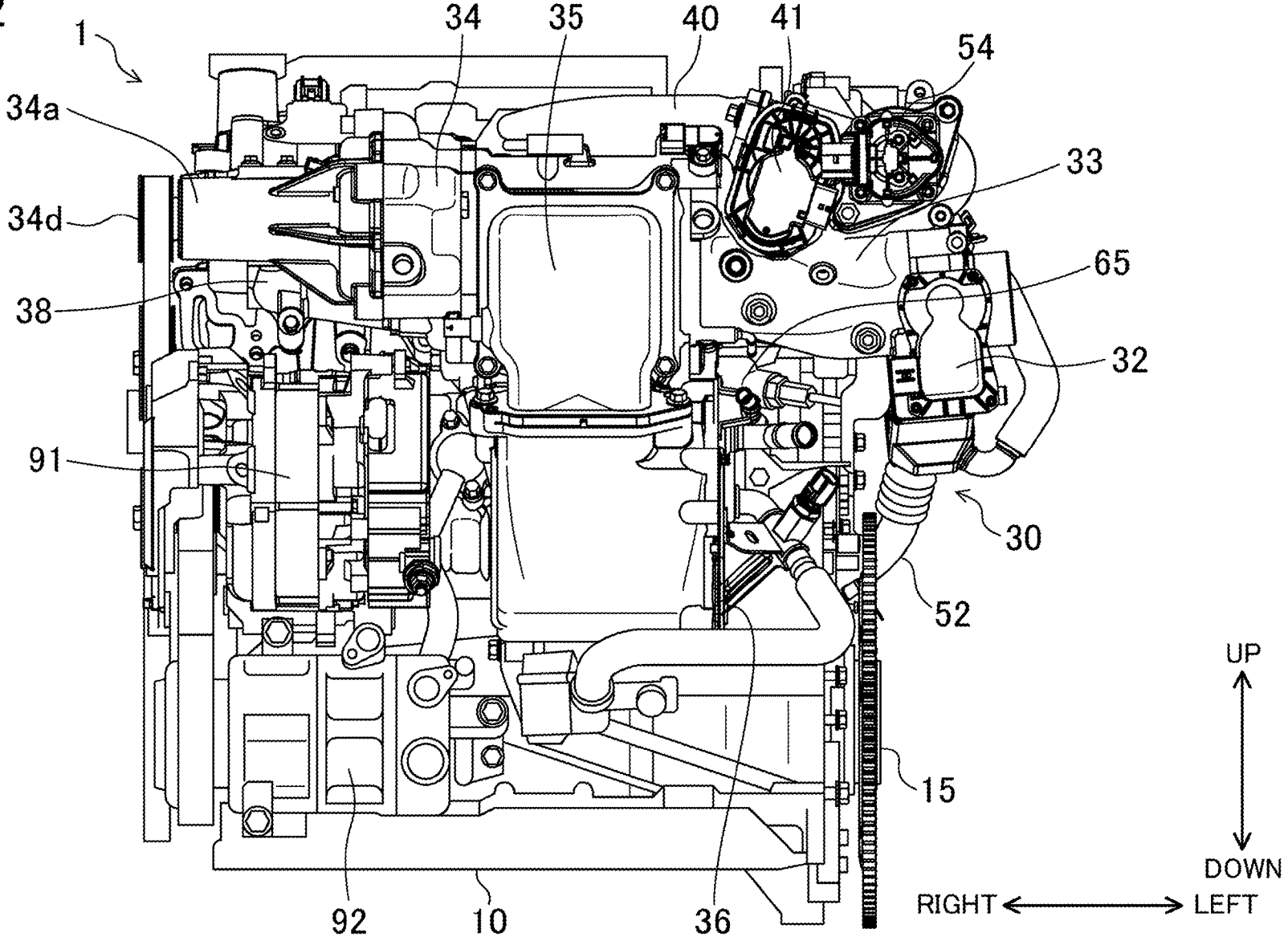
FIG. 2 is a front view of the engine.
Figure 3:
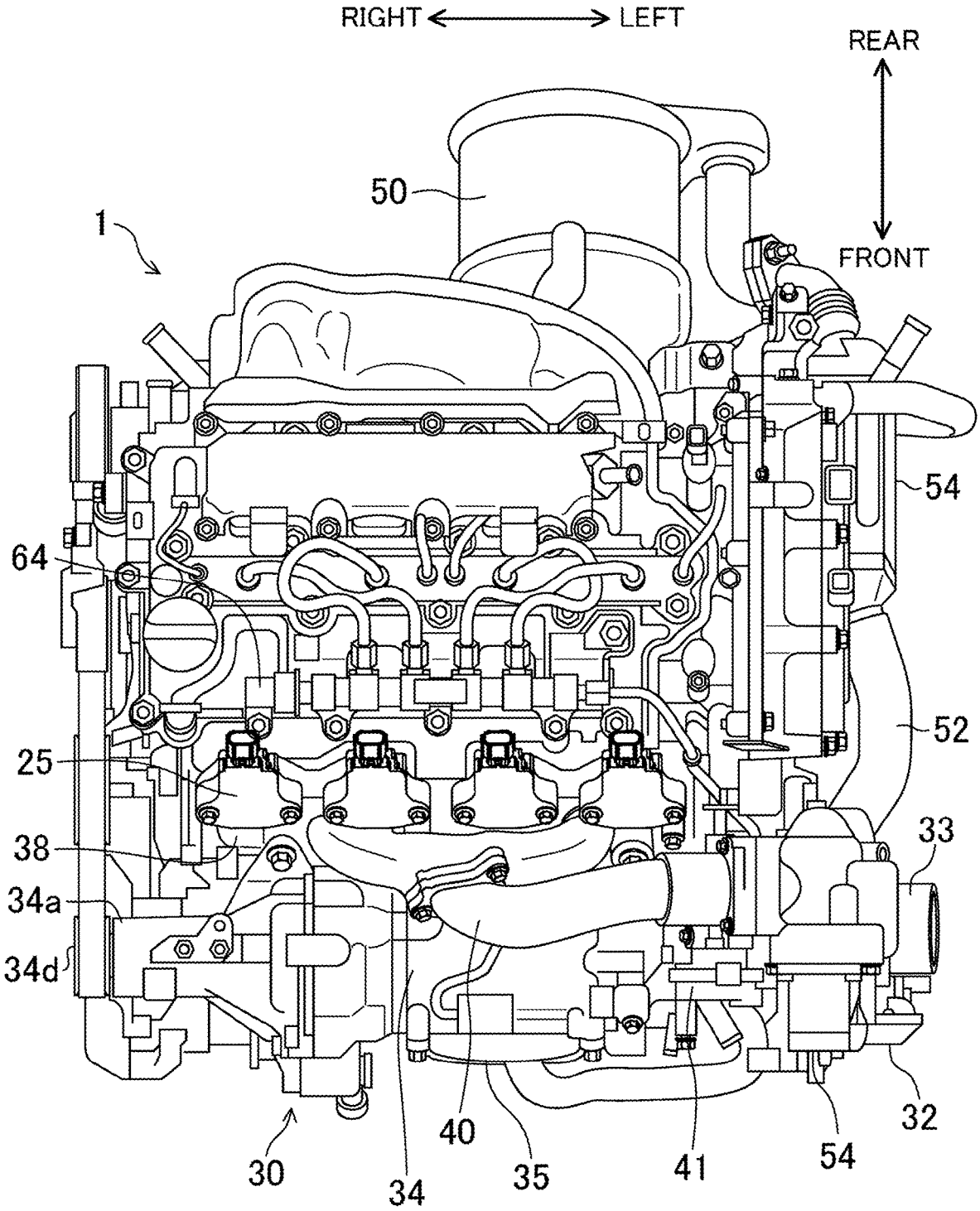
FIG. 3 is a top view of the engine.

An embodiment of an intake system for an engine will now be described in detail with reference to the drawings. The following description is a mere example. FIG. 1 is a schematic view illustrating an exemplary configuration of an engine 1 employing the intake system for the engine disclosed herein. FIG. 2 is a front view of the engine 1. FIG. 3 is a top view of the engine 1.

The engine 1 is a four-stroke internal combustion engine mounted in a four-wheeled motor vehicle and including a mechanical supercharger 34 as shown in FIGS. 1 to 3. The fuel of the engine 1 is gasoline in this exemplary configuration.

Although not shown in detail, the engine 1 is what is called an in-line four-cylinder transverse engine including four cylinders 11 arranged in line. The four cylinders 11 are mounted, while being aligned in the transverse direction of the vehicle. In this exemplary configuration, the front-rear direction of the engine in which the four cylinders 11 are arranged (i.e., along the cylinder bank) is substantially the same as the transverse direction of the vehicle. The transverse direction of the engine is substantially the same as the front-rear direction of the vehicle.

In an in-line multi-cylinder engine, the direction of the cylinder bank is the same as the direction of the center axis of a crankshaft 15 that serves as an output shaft of the engine (i.e., along the output shaft of the engine). In the following description, these directions may be collectively referred to as the direction "along the cylinder bank" (or the "transverse direction of the vehicle"). The direction "along the cylinder bank" is an example of the "predetermined direction" that exemplarily represents the direction along the horizontal plane (i.e., the horizontal direction) in this exemplary configuration.

Hereinafter, unless otherwise noted, the term "front" means the front in the front-rear direction of the vehicle, while the term "rear" means the rear in the front-rear direction of the vehicle. The "left" means one side in the transverse direction of the vehicle (along the cylinder bank, toward the rear of the engine), while the "right" means the other side in the transverse direction of the vehicle (along the cylinder bank, toward the front of the engine).

In the following description, the term "upper side" means the upper side in the vertical direction of the vehicle in a state in which the engine 1 is mounted in the vehicle (hereinafter also referred to as an "in-vehicle state"), while the term "lower side" means the lower side in the vertical direction of the vehicle in the in-vehicle state.

(General Configuration of Engine)

In this exemplary configuration, the engine 1 is of a front-intake and rear-exhaust type. Specifically, the engine 1 includes an engine body 10, an intake passage 30, and an exhaust passage 50. The engine body 10 includes the four cylinders 11. The intake passage 30 is located in front of the engine body 10 and communicates with the cylinders 11 via intake ports 18.The exhaust passage 50 is located behind the engine body 10 and communicates with the cylinders 11 via exhaust ports 19.

In this exemplary configuration, the intake passage 30 is an intake device including: a plurality of passages introducing gas; devices such as a supercharger 34 and an intercooler 36; and an air bypass passage (hereinafter simply referred to as a "bypass passage") 40 bypassing these devices and leads to a combustion chamber 16, all of which are combined as a unit. This intake device constitutes an intake system according to the present embodiment together with the intake passage 30, a throttle valve 32, and an EGR passage 52.

In the cylinders 11, the engine body 10 burns a mixture of fuel and gas supplied from the intake passage 30 in a predetermined combustion order. Specifically, the engine body 10 includes a cylinder block 12, and a cylinder head 13 above the cylinder block 12.

The cylinder block 12 includes therein the four cylinders 11 described above. The four cylinders 11 are arranged in line along the central axis of the crankshaft 15 (i.e., along the cylinder bank). Note that FIG. 1 shows only one of the cylinders 11.

A piston 14 is slidably fitted into each of the cylinders 11. The piston 14 is coupled to the crankshaft 15 through a connecting rod 141. The piston 14 defines a combustion chamber 16 together with the cylinder 11 and the cylinder head 13. Note that the "combustion chamber" used herein is not limited to a space defined when the piston 14 reaches a compression top dead center. The term "combustion chamber" is used in a broad sense.

The cylinder head 13 has two intake ports 18 provided for each cylinder 11. FIG. 1 illustrates only one of the intake ports 18. The two intake ports 18 are adjacent to each other along the cylinder bank and communicate with the associated one of the cylinders 11.

Each of the two intake ports 18 is provided with an intake valve 21. Each intake valve 21 allows and prohibits communications between the combustion chamber 16 and the associated one of the intake ports 18. The intake valve 21 is opened and closed by an intake valve train mechanism at predetermined timing.

In this exemplary configuration, the intake valve train mechanism includes an electric intake sequential-valve timing (S-VT) 23 serving as a variable valve mechanism as shown in FIG. 1. The electric intake S-VT 23 continuously changes a rotational phase of an intake camshaft within a predetermined angle range. Accordingly, an opening time point and a closing time point of the intake valve 21 change continuously. Note that the intake valve train mechanism may include a hydraulic S-VT instead of the electric intake S-VT 23.

The cylinder head 13 also includes two exhaust ports 19 for each cylinder 11. FIG. 1 illustrates only one of the exhaust ports 19. The two exhaust ports 19 are adjacent to each other along the cylinder bank and communicate with the associated one of the cylinders 11.

Each of the two exhaust ports 19 is provided with an exhaust valve 22. Each exhaust valve 22 allows and prohibits communications between the combustion chamber 16 and the associated one of the exhaust ports 19. The exhaust valve 22 is opened and closed by an exhaust valve train mechanism at predetermined timing.

In this exemplary configuration, the exhaust valve train mechanism includes an electric exhaust sequential-valve timing (S-VT) 24 serving as a variable valve train mechanism as shown in FIG. 1. The electric exhaust S-VT 24 continuously changes a rotational phase of an exhaust camshaft within a predetermined angle range. Accordingly, the opening and closing times of the exhaust valve 22 alternate continuously. Note that the exhaust valve train may include a hydraulic S-VT instead of the electric S-VT 24.

The cylinder head 13 includes an injector 6 for each cylinder 11. In this exemplary configuration, the injector 6 is a multi-nozzle fuel injection valve which directly injects fuel into the combustion chamber 16.

The injector 6 is connected to a fuel supply system 61. The fuel supply system 61 includes a fuel tank (not shown) which stores fuel, and a fuel supply passage 62 connecting the fuel tank and the injector 6 together. The fuel supply passage 62 is interposed between a fuel pump 65 and a common rail 64. The fuel pump 65 pumps out fuel to the common rail 64. In this exemplary configuration, the fuel pump 65 is a plunger pump driven by the crankshaft 15. The common rail 64 stores the fuel pumped out of the fuel pump 65 at a high fuel pressure. When the injector 6 opens, the fuel stored in the common rail 64 is injected through the nozzle of the injector 6 into the combustion chamber 16.

The cylinder head 13 has a spark plug 25 provided for each cylinder 11. The tip of the spark plug 25 faces the inside of the combustion chamber 16 to forcibly ignite the air-fuel mixture inside the combustion chamber 16.

Referring back to the description of the intake passage 30, the intake passage 30 in this exemplary configuration is connected to one side surface (specifically, a front side surface) of the engine body 10 and communicates with the intake ports 18 of the respective cylinders 11. Specifically, the intake passage 30 allows the gas to be introduced into the combustion chamber 16 to pass therethrough and is connected through the intake ports 18 to the combustion chamber 16.

An air cleaner 31 filtering fresh air is provided at the upstream end of the intake passage 30. On the other hand, a surge tank 38 is provided near the downstream end of the intake passage 30. The part of the intake passage 30 located downstream of the surge tank 38 branches off into independent passages 39, two of which are distributed to each cylinder 11. The downstream ends of the independent passages 39 are connected to the intake ports 18 of the cylinders 11.

The throttle valve 32 is disposed in the intake passage 30 between the air cleaner 31 and the surge tank 38. An opening of the throttle valve 32 is adjusted to regulate the amount of fresh air to be introduced into the combustion chamber 16.

In the intake passage 30, the supercharger 34 is disposed downstream of the throttle valve 32. The supercharger 34 supercharges the gas to be introduced into the combustion chamber 16. In this exemplary configuration, the supercharger 34 is mechanically driven by the engine 1 (specifically, power transmitted from the crankshaft 15). This supercharger 34 is a Roots supercharger but not limited thereto. Examples of the supercharger 34 include a Lysholm supercharger and a centrifugal supercharger.

An electromagnetic clutch 34*a* is interposed between the supercharger 34 and the crankshaft 15. The electromagnetic clutch 34*a* transmits and blocks driving force between the supercharger 34 and the crankshaft 15. A control unit (not shown) such as an engine control unit (ECU) selectively engages and disengages the electromagnetic clutch 34*a* to turn on and off the supercharger 34. Specifically, the operation of this engine 1 is switched between a mode of supercharging the gas to be introduced into the combustion chamber 16 and a mode of not supercharging the gas to be introduced into the combustion chamber 16, by turning on and off the supercharger 34.

In the intake passage 30, the intercooler 36 is disposed downstream of the supercharger 34. The intercooler 36 cools the gas compressed by the supercharger 34. The intercooler 36 of this exemplary configuration is of a water-cooling type.

As a passage connecting various kinds of devices incorporated in the intake passage 30, the intake passage 30 includes: a first passage 33 downstream of the air cleaner 31 and guiding the gas filtered through the air cleaner 31 to the supercharger 34; a second passage 35 guiding the gas compressed by the supercharger 34 to the intercooler 36; and a third passage 37 guiding the gas cooled by the intercooler 36 to the surge tank 38.

In the intake passage 30, the first passage 33, the second passage 35, the third passage 37, and the surge tank 38 constitute a "main intake passage" in which the supercharger 34 and the intercooler 36 are interposed in this order from the upstream end along the flow of the gas. Hereinafter, a reference character "30A" may be assigned to the main intake passage. The main intake passage 30A is an example of a "first passage section."

In addition to the main intake passage 30A, the intake passage 30 includes a bypass passage 40 that bypasses the supercharger 34 and the intercooler 36. Specifically, the bypass passage 40 branches off from upstream of the supercharger 34 in the main intake passage 30A and is connected to the downstream end of the intercooler 36. More specifically, the bypass passage 40 connects the surge tank 38 to the part of the main intake passage 30A from the downstream end of the throttle valve 32 to the upstream end of the supercharger 34.

The bypass passage 40 is also provided with an air bypass valve (hereinafter simply referred to as a "bypass valve") 41 for changing a cross-sectional flow area of the bypass passage 40. The bypass valve 41 changes the cross-sectional flow area of the bypass passage 40 to adjust the flow rate of the gas flowing through the bypass passage 40. Here, the bypass passage 40 is an example of the "second passage section," and the bypass valve 41 is an example of the "second valve."

Figure 4:
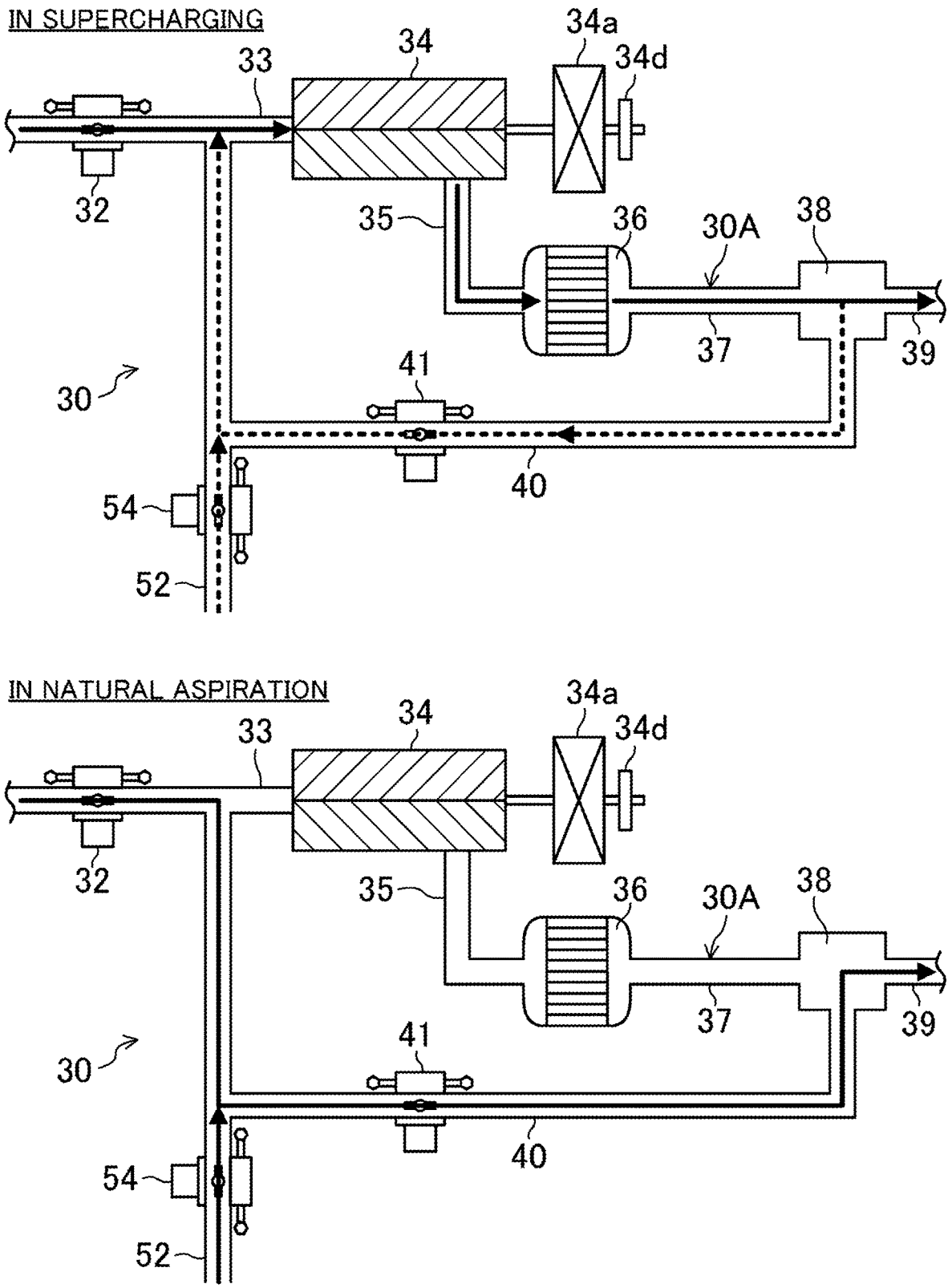
FIG. 4 illustrates a comparison between the flow of gas in an intake passage during supercharging and during natural aspiration.

When the supercharger 34 is turned off (i.e., when the electromagnetic clutch 34a is disengaged), the bypass valve 41 is fully open. This allows the gas flowing through the intake passage 30 to bypass the supercharger 34 and flow into the surge tank 38 and to be introduced through the independent passages 39 into the combustion chamber 16, as shown in the lower view of FIG. 4. The engine 1 is operated without supercharging, that is, by natural aspiration.

When the supercharger 34 is turned on (i.e., when the electromagnetic clutch 34*a* is engaged), the opening of the bypass valve 41 is adjusted as appropriate. This allows part of gas passed through the supercharger 34 in the intake passage 30 to flow back upstream of the supercharger 34 through the bypass passage 40, as shown in the upper view of FIG. 4. A rate of the backflow gas can be adjusted through adjustment of the opening of the bypass valve 41. Through the backflow rate, a supercharging pressure of the gas to be introduced into the combustion chamber 16 can be adjusted. In this exemplary configuration, the supercharger 34, the bypass passage 40, and the bypass valve 41 constitute a supercharging system.

On the other hand, the exhaust passage 50 is connected to the other side surface (specifically, the rear side surface) of the engine body 10 and communicates with the exhaust ports 19 of the cylinders 11. The exhaust passage 50 conducts exhaust gas discharged from the combustion chamber 16. Although not shown in detail, an upstream part of the exhaust passage 50 serves as independent passages, each of which branches off for one of the cylinders 11. An upstream end of each independent passage is connected to a corresponding one of the exhaust ports 19 of the cylinders 11.

The exhaust passage 50 is provided with an exhaust gas purification system including one or more catalyst converters 51. Each of the catalyst converters 51 contains a three-way catalyst. Note that the exhaust gas purification system may include any catalyst in addition to the three-way catalyst.

The EGR passage 52 serving as an external EGR system is connected between the intake passage 30 and the exhaust passage 50. The EGR passage 52 allows part of the burnt gas to flow back to the intake passage 30. Specifically, an upstream end of the EGR passage 52 is connected to a part of the exhaust passage 50 downstream of the catalyst converter 51. On the other hand, a downstream end of the EGR passage 52 is connected to a part of the intake passage 30 upstream of the supercharger 34 and downstream of the throttle valve 32.

The EGR passage 52 is provided with a water-cooled EGR cooler 53. The EGR cooler 53 cools the burnt gas. An EGR valve 54 adjusts a flow rate of the burnt gas flowing through the EGR passage 52. On the paper of FIG. 1, the EGR valve 54 seems to be disposed on the EGR passage 52. In an actual configuration, however, the EGR valve 54 is disposed on the bypass passage 40 as will be described later. Through adjustment of the opening of the EGR valve 54, the backflow rate of the cooled burnt gas; that is, the external EGR gas, can be adjusted.

In this exemplary configuration, an EGR system 55 includes the external EGR system including the EGR passage 52 and the EGR valve 54, and an internal EGR system including the electric intake S-VT 23 and the electric exhaust S-VT 24 described above.

The engine 1 also includes various auxiliary machines in addition to the fuel pump 65 described above. The engine 1 includes, as such auxiliary machines, an alternator 91, an air conditioner 92, and a water pump (not shown). The alternator 91 generates an alternating current used in an electric system. The air conditioner 92 conditions air. The water pump circulates cooling water.

As shown in FIG. 2, the fuel pump 65 is attached to the front left end of the engine body 10. By contrast, the alternator 91 and the air conditioner 92 are attached to the front right end of the engine body 10. The alternator 91 and the air conditioner 92 are arranged in this order from above. In addition, a drive pulley 34*d* of the supercharger 34 is located above the alternator 91. Although not shown in detail, a timing belt for driving the supercharger 34 is wound around the drive pulley 34*d*.

(Configuration of Intake Passage)

A configuration of the main part of the intake passage 30 will now be described in detail.

Figure 5:
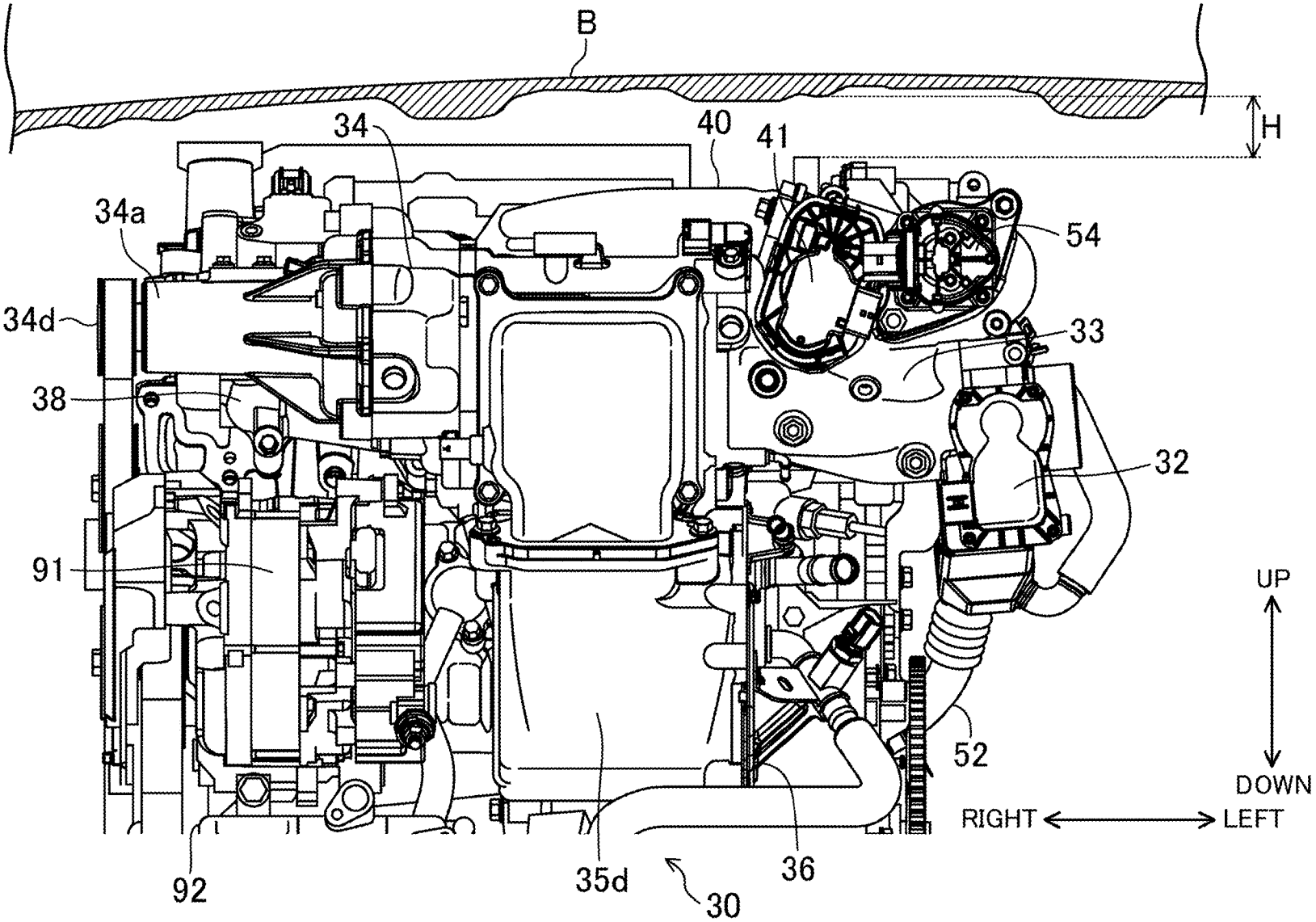
FIG. 5 is front view of the intake passage.
Figure 6:
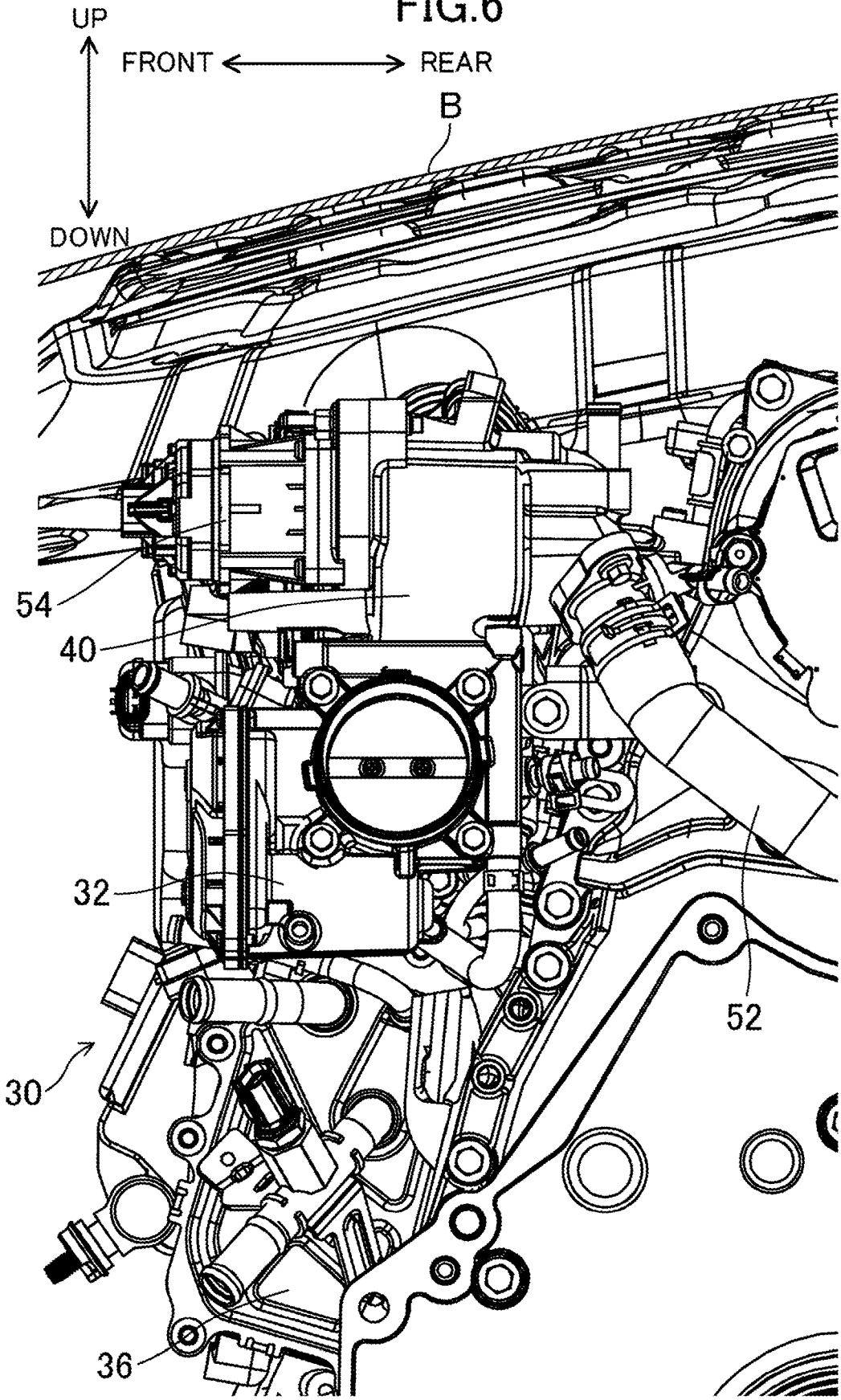
FIG. 6 is a left view of the intake passage.
Figure 7:
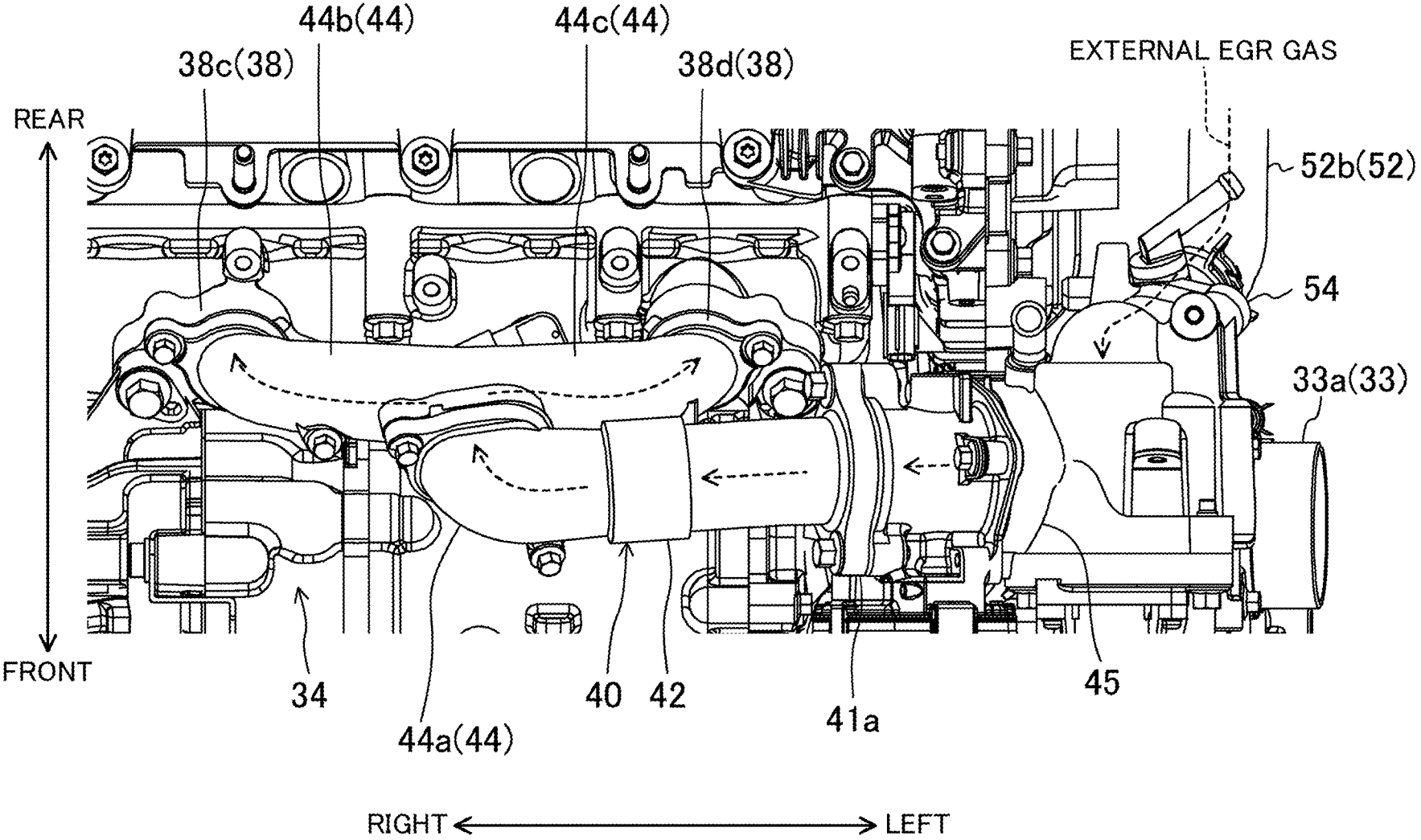
FIG. 7 is a top view of the intake passage.
Figure 8:
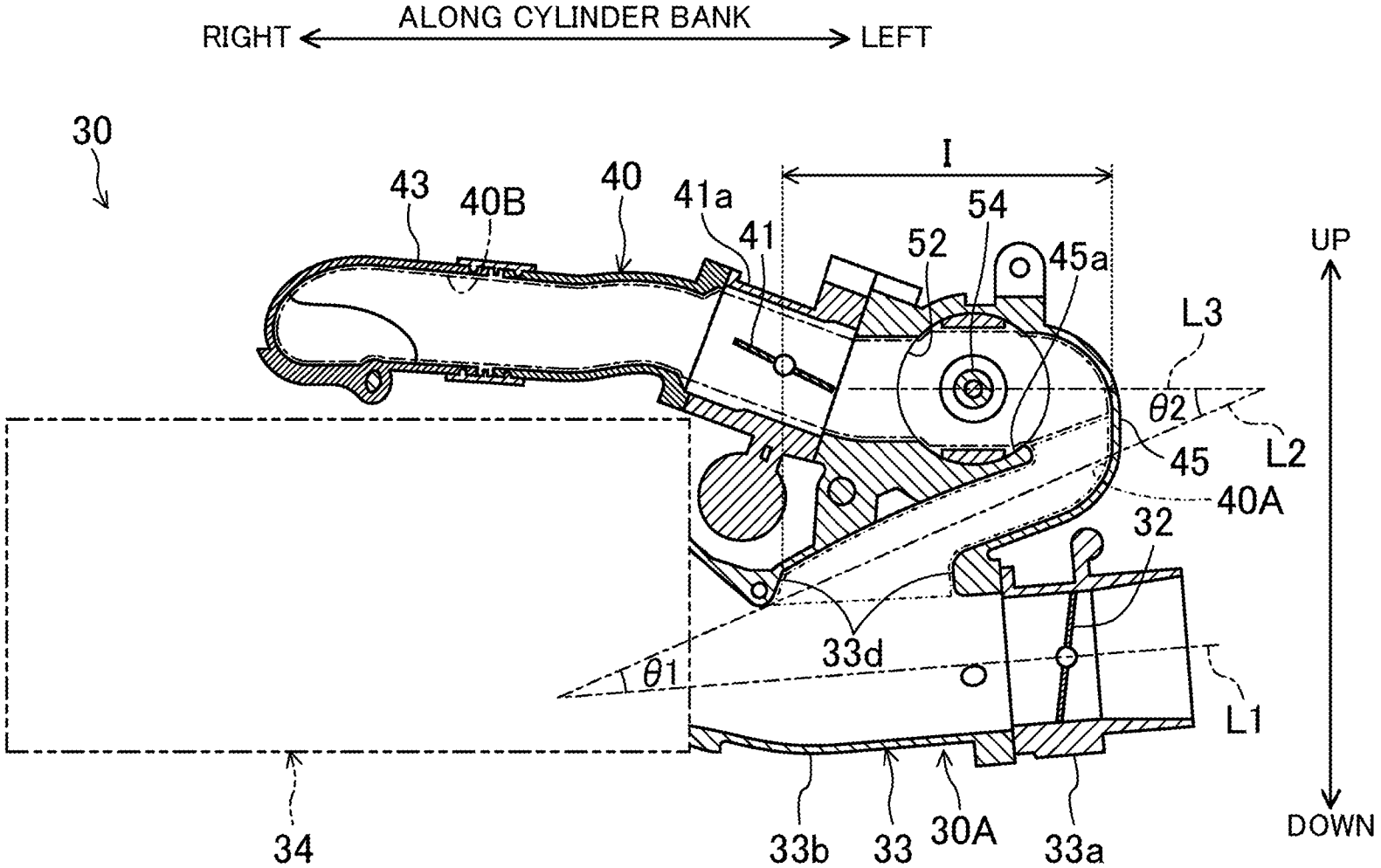
FIG. 8 is a longitudinal-sectional view of the intake passage.
Figure 9:
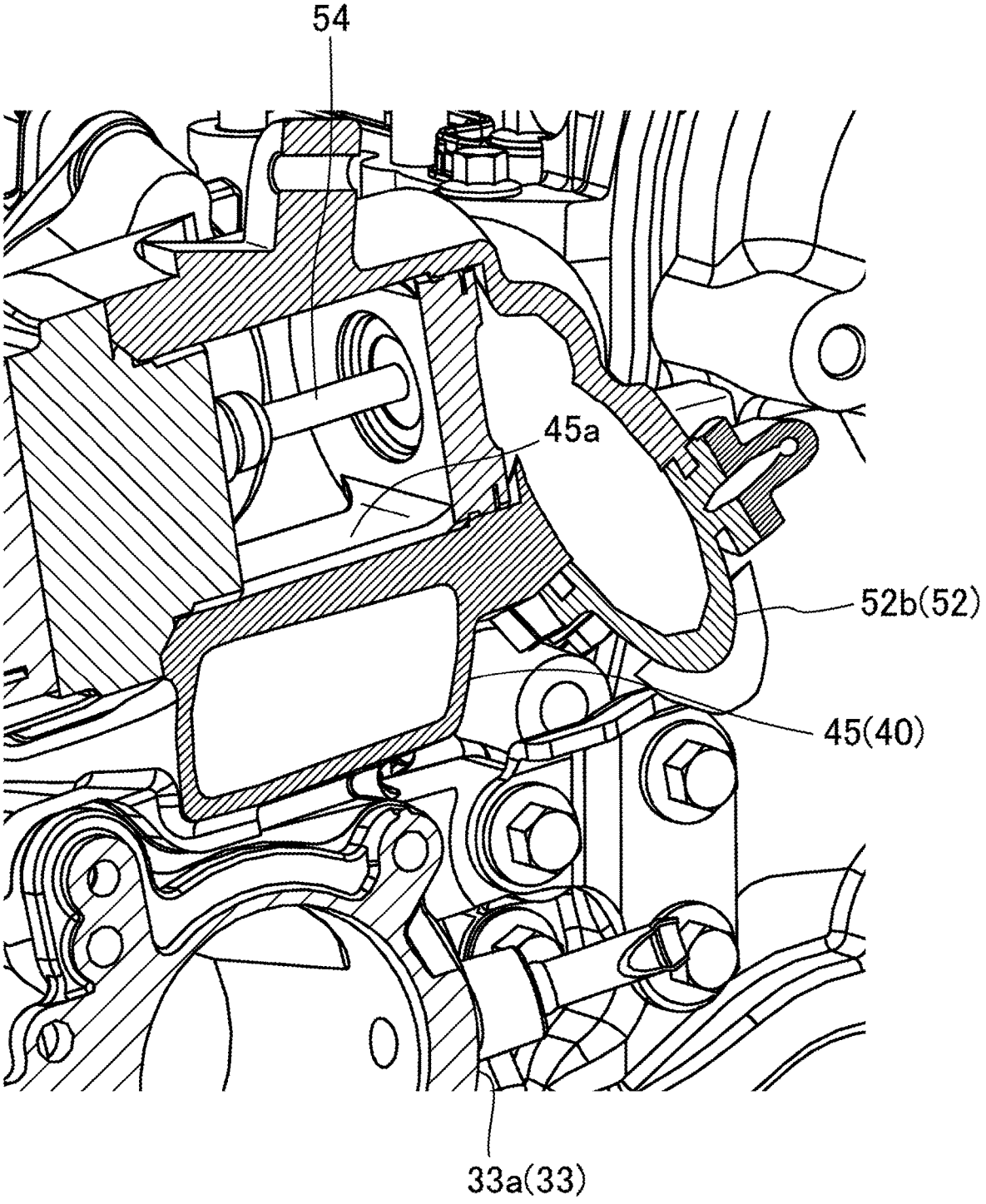
FIG. 9 is a transverse-sectional view of the intake passage.

FIG. 5 is a front view of the intake passage 30. FIG. 6 is a left view of the intake passage 30. FIG. 7 is a top view of the intake passage 30. FIG. 8 is a longitudinal-sectional view of the intake passage 30. FIG. 9 is a transverse-sectional view of the intake passage 30.

Constituent parts of the intake passage 30 are arranged in front of the engine body 10, specifically, along the front surfaces of the cylinder head 13 and the cylinder block 12.

As described above, the intake passage 30 includes: a plurality of passages (specifically, the first passage 33, the second passage 35, the third passage 37, the surge tank 38, and the independent passage 39) to introduce gas; devices such as the supercharger 34 and the intercooler 36; and the bypass passage 40 bypassing these devices, all of which are combined. As shown FIGS. 5 to 8, the main intake passage 30A constituting the intake passage 30 is located below the bypass passage 40.

Described first is a schematic layout of these constituent elements.

As shown in FIGS. 5 to 7, the supercharger 34 is opposed to the engine body 10 with the surge tank 38 interposed therebetween. Between the rear surface of the supercharger 34 and the front surface of the engine body 10, there is a gap in a size corresponding to the size of the surge tank 38. The first passage 33 extends along the cylinder bank at the left end of the supercharger 34 and is connected to the left end of the supercharger 34. The supercharger 34 is located above the intercooler 36. The supercharger 34 and the intercooler 36 are arranged side by side in the vertical direction. The second passage 35 extends vertically to connect the front of the supercharger 34 to the front of the intercooler 36. The surge tank 38 is located in the gap between the supercharger 34 and the engine body 10 and opposed to the upstream ends of the intake ports 18 with the independent passages 39 interposed therebetween. The third passage 37 extends through the gap between (i) the intercooler 36 and the supercharger 34 and (ii) the engine body 10. The third passage 37 connects the rear of the intercooler 36 to the bottom of the surge tank 38 so that the intercooler 36 is located below the surge tank 38. The bypass passage 40 extends upward in a middle of the first passage 33 and then toward the inside (i.e., the right) of the engine body 10. The bypass passage 40 branches off into two at its downstream ends, which are connected to upper parts of the surge tank 38.

As can be seen from FIG. 5, the EGR valve 54 and the bypass valve 41 are arranged between the supercharger 34 and the throttle valve 32 along the cylinder bank. Specifically, the EGR valve 54 is located at the upper right of the throttle valve 32. On the other hand, the bypass valve 41 is located substantially at the right of the EGR valve 54 and the upper left of a suction port of the supercharger 34 introducing gas (at the left end of the supercharger 34 in this exemplary configuration). In this manner, the layout is made to locate both the EGR valve 54 and the bypass valve 41 between the throttle valve 32 and the left end of the supercharger 34 along the cylinder bank.

As will be described later in detail, this engine 1 is configured so that the EGR valve 54 and the bypass valve 41 are close to the throttle valve 32. Such integration achieves the layout as described above.

Such a layout reduces the size of the engine 1 in the vertical direction of the vehicle as compared to arrangement of the EGR valve 54 and the bypass valve 41 right above the supercharger 34, for example. This provides a more sufficient distance (see the distance H in FIG. 5) between the engine 1 and a hood B as shown in FIGS. 5 and 6 without increasing the size of the engine 1 in the front-rear direction of the vehicle.

Even if the EGR valve 54 and the bypass valve 41 are arranged right above the supercharger 34, changing the mounting position of the supercharger 34 right downward could increase the distance between the engine 1 and the hood B. However, as described above, the surge tank 38 is opposed to the upstream ends of the intake ports 18 with the independent passages 39 interposed therebetween. In this configuration, changing the position of the supercharger 34 downward leads to an increase in the length of the flow path from the surge tank 38 to the intake ports 18 and leaves room for improvement in terms of the responsiveness of the gas. In addition, as shown in FIG. 5, in changing the position of the supercharger 34 downward, the interference between the supercharger 34 and the auxiliary devices (specifically, interference between the drive pulley 34*d* and the alternator 91) needs to be avoided. This requires a change in the overall layout of the entire engine 1, which causes trouble and inconvenience.

By contrast, the layout described above is also advantageous in saving such trouble. In order to describe the layout relating to the integration of the throttle valve 32, the bypass valve 41, and the EGR valve 54 in detail, configurations of the constituent parts of the intake passage 30 will be described sequentially.

The first passage 33 is provided with the throttle valve 32 and extends from one side toward the other (specifically, from the left to the right) along the cylinder bank. Specifically, as shown in FIG. 8, the first passage 33 is in the shape of a tube extending along the cylinder bank (i.e., transversely). The upstream part (i.e., the left) of the first passage 33 is configured as a throttle body 33*a* with the built-in throttle valve 32. The throttle body 33*a* is made of metal in the shape of a short cylinder and located at the left and in front of the front surface of the engine body 10 with openings at both ends of the throttle body 33*a* facing respective right and left sides. The upstream end (i.e., the left end) of the throttle body 33*a* is connected to the air cleaner 31 via a passage (not shown), while the downstream end (i.e., the right end) of the throttle body 33*a* is connected to a first passage body 33*b*, which is the upstream end (i.e., the left) of the first passage 33.

As shown in FIG. 8, the first passage body 33*b* connects the throttle body 33*a* to the supercharger 34. Specifically, the first passage body 33*b* is in the shape of a long cylinder with openings at both ends facing respective right and left sides. The first passage body 33*b* is substantially coaxial with the throttle body 33*a* in front of the engine body 10. More specifically, the diameter of the first passage body 33*b* gradually increases from the one side to the other (specifically, from the left to the right) along the cylinder bank. As described above, the upstream end (i.e., the left end) of the first passage body 33*b* is connected to the downstream end of the throttle body 33*a*. On the other hand, the downstream end (i.e., the right end) of the first passage body 33*b* is connected to the suction port of the supercharger 34.

The first passage body 33*b* has a branch 33*d* connected to the bypass passage 40. This branch 33*d* is formed on the upper surface of the first passage body 33*b*, and connected to the upstream end (a curving pipe 45, which will be described later) of the bypass passage 40. That is, as can be seen from FIG. 8, the branch 33*d* is located on the other side (i.e., the right) of the throttle valve 32 in the first passage 33 (eventually the main intake passage 30A).

Accordingly, fresh air purified in the air cleaner 31 and flowed into the first passage 33 passes through the throttle valve 32 to reach the first passage body 33*b*. In natural aspiration, this fresh air flows through the branch 33*d* into the bypass passage 40. On the other hand, in supercharging, the fresh air joins the gas that flows back through the bypass passage 40 and is sucked into the supercharger 34 from the downstream end of the first passage body 33*b* (see also FIG. 4).

—Configuration of Bypass Passage—

Next, a configuration of the bypass passage 40 will be described in detail.

As shown in FIG. 8, the bypass passage 40 is connected to a part (i. e., the branch 33*d*) of the main intake passage 30A (specifically, the first passage 33) located on the other side (i.e., the right) of the throttle valve 32.

Specifically, as shown in FIG. 8, the bypass passage 40 extends obliquely upward to the left from the branch 33*d* open at the first passage body 33*b* and then extends substantially straight to the right. The part of the bypass passage 40 extending toward the right changes the direction to head obliquely downward and backward once reaching the region around the center of the surge tank 38 (specifically, around the center along the cylinder bank) and then branches off into two. Each of the branching passages is connected to the upper surface of the surge tank 38.

Here, the bypass passage 40 includes the curving pipe 45, a valve body 41*a*, a straight pipe 43, and a branch pipe 44 in this order from the upstream end. The curving pipe 45 changes the direction of the gas that has flowed from the branch 33*d*. The valve body 41*a* includes the built-in bypass valve 41. The straight pipe 43 guides the gas that has passed through the valve body 41*a* toward the right. The branch pipe 44 guides the gas that has passed through the straight pipe 43 obliquely downward and backward and branching off into two to be connected to the surge tank 38.

Because the valve body 41*a* is arranged downstream of the curving pipe 45, the downstream end of the EGR passage 52 is to be connected upstream of the bypass valve 41 in the bypass passage 40. The curving pipe 45 has a part connected to the downstream end of the EGR passage 52 and having a lower wall surface 45*a* recessed downward. This lower wall surface 45*a* has a structure to receive water.

In order to achieve the integration of the throttle valve 32, the EGR valve 54, and the bypass valve 41, the bypass passage 40 extends to the left from the branch 33*d* connected to the main intake passage 30A and then turns back to extend to the right. The EGR valve 54 is located in a part (see section I of FIG. 8) of the bypass passage 40 extending to the right (hereinafter referred to as a "parallel passage section" with reference character "40B") and overlapping, along the cylinder bank, with a part extending to the left from the branch 33*d* (hereinafter referred to as a "joint passage section" with reference character "40A").

Specifically, as shown in FIG. 8, the joint passage section 40A constituting the bypass passage 40 extends obliquely with respect to the first passage 33 of the main intake passage 30A so as to head from the right to the left with an increasing distance from the branch 33*d*. On the other hand, the parallel passage section 40B is connected to the left end of the joint passage section 40A and extends toward the right. Here, the center axis (see the straight line L2) of the joint passage section 40A is at acute angles (see angles θ1 and θ2 in FIG. 8) from the center axis (see the straight line L1) of the first passage 33 and the center axis (see the straight line L3) of the parallel passage section 40B.

The center axis of the joint passage section 40A extends along the gas (particularly, the main flow of gas) flowing from the parallel passage section 40B through the joint passage section 40A toward the first passage 33. The center axis of the parallel passage section 40B extends along the gas (particularly, the main flow of gas) flowing from the joint passage section 40A through the joint passage section 40B to the surge tank 38.

Focusing on the relative positional relationship with the EGR valve 54, it can also be seen in FIG. 8 that the joint passage section 40A passes through the gap between the first passage 33 and the EGR valve 54 in the vertical direction.

In this exemplary configuration, the joint passage section 40A is a part of the curving pipe 45, whereas the parallel passage section 40B includes another part of the curving pipe 45, the valve body 41*a*, and the straight pipe 43.

Described below in detail are the constituent parts of the bypass passage 40.

The curving pipe 45 is in the shape of a cylinder extending obliquely upward from the branch 33*d* to the left and then substantially straight to the right and provided above the first passage 33 (i.e., above the main intake passage 30A serving as the first passage section) with one opening facing downward and the other facing the right.

The part of the curving pipe 45 extending obliquely upward from the branch 33*d* to the left serves as the joint passage section 40A described above. The diameter of this part gradually increases with a decreasing distance to the lower right. Such a configuration is advantageous in increasing the opening area of the branch 33*d*.

On the other hand, the part of the curving pipe 45 extending substantially straight toward the right serves as the parallel passage section 40B described above. The part of the curving pipe 45 serving as the parallel passage section 40B overlaps the part serving as the joint passage section 40A along the cylinder bank. As shown in FIGS. 8 to 9, the part serving as the parallel passage section 40B is provided with the EGR valve 54.

Accordingly, the gas that has flowed into the curving pipe 45 flows obliquely upward to the left. The flow direction of the gas then changes along the turn of the curving pipe 45. As a result, the gas flowing through the curving pipe 45 flows from outside to inside (i.e., from the left to the right) along the cylinder bank. As already described, the first passage body 33*b* is connected via the branch 33*d* to the upstream end (i.e., the lower end) of the curving pipe 45, while the upstream end (i.e., the left end) of the valve body 41*a* is connected to the downstream end (i.e., the right end) of the curving pipe 45.

The valve body 41*a* is in the shape of a short cylinder and is located above the first passage 33 and on the left of the supercharger 34 with openings at both ends facing respective right and left sides as shown in FIG. 8. As described above, the upstream end of the valve body 41*a* is connected to the downstream end of the curving pipe 45, while the downstream end (i.e., right end) of the valve body 41*a* is connected to the upstream end (i.e., left end) of the straight pipe 43.

The straight pipe 43 is in the shape of a long cylinder extending from one side toward the other side (specifically from left to right) along the cylinder bank. As can be seen in FIG. 8, for example, the straight pipe 43 is located above the first passage 33 and the supercharger 34 with openings at both ends facing respective right and left sides. As already described, the upstream end of the straight pipe 43 is connected to the downstream end of the valve body 41*a*, while the upstream end (i.e., the left end) of the straight pipe 43 is connected to the downstream end (i.e., the right end) of the branch pipe 44.

The branch pipe 44 includes: a bent passage 44*a* bent like an elbow; and two branch passages 44*b* and 44*c* branching off like a tournament chart from the downstream end of the bent passage 44*a*. The branch pipe 44 is located above the supercharger 34 and the surge tank 38 with the upstream end of the bent passage 44*a* facing the left and both the two branch passages 44*b* and 44*c* facing obliquely downward and backward.

The two branch passages 44*b* and 44*c* are substantially the same in length. One of the branch passages; namely the first branch passage 44*b*, extends from the branch point to the right along the cylinder bank and is then bent obliquely downward and backward. On the other hand, the other branch passage; namely the second branch passage 44*c*, extends from the branch point to the left along the cylinder bank and is then bent obliquely downward and backward. The downstream ends of the two branch passages 44*b* and 44*c* are connected to the upper surface of the surge tank 38, as described above.

In natural aspiration, the gas that has flowed into the bypass passage 40 passes through the constituent parts of the bypass passage 40 to reach the cylinders 11. That is, the gas that has passed through the throttle passage 32 flows from an intermediate part of the first passage 33 into the curving pipe 45 of the bypass passage 40, depending on the opening/closing state of the bypass valve 41. The gas that has flowed through the curving pipe 45 into the valve body 41*a* flows toward the right as indicated by the arrow of FIG. 7.

As indicated by the arrow, the gas that has passed through the valve body 41*a* then flows to the right along the straight pipe 43 and thereafter flows into the branch pipe 44. As indicated by the other arrows, the gas that has flowed into the branch pipe 44 passes through the bent passage 44*a* and is then distributed to the first and second branch passages 44*b* and 44*c*. Each distributed gas flows into the surge tank 38. The gas that has flowed into the surge tank 38 is supplied through the independent passages 39 to the intake ports 18 of the cylinders 11.

On the other hand, in supercharging, the gas that has flowed back from the surge tank 38 to the bypass passage 40 flows through the respective parts of the bypass passage 40 in the direction opposite to the direction in natural aspiration and flows into the first passage 33.

As described above, the downstream end of the EGR passage 52 is connected to the curving pipe 45 of the bypass passage 40. Hence, the bypass passage 40 conducts not only the gas flowing from the first passage 33 and the gas flowing back from the surge tank 38, but also the external EGR gas.

—Configuration of EGR Passage—

A configuration of the EGR passage 52 will now be described in detail.

Figure 10:
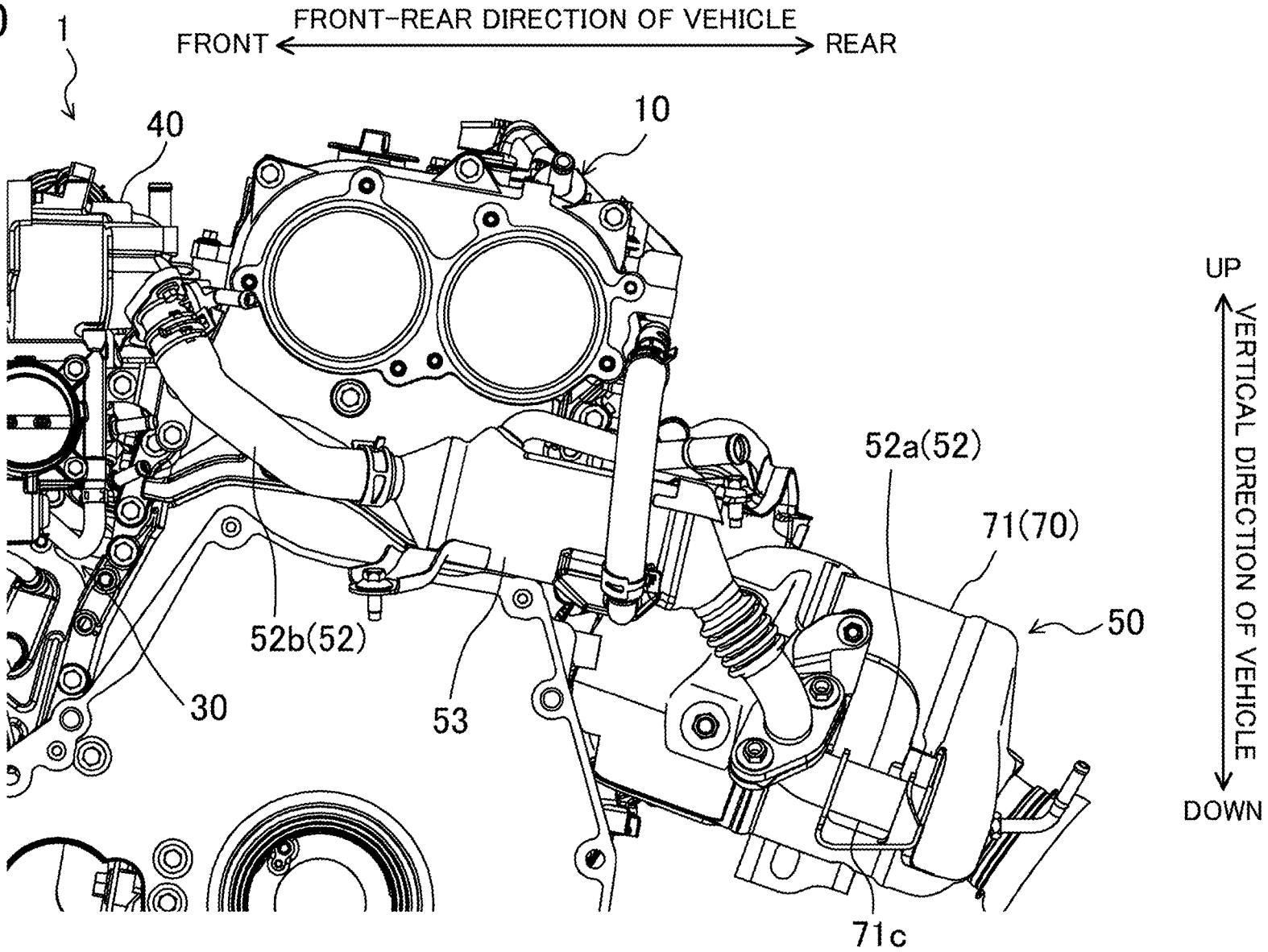
FIG. 10 is a left view of an EGR passage.
Figure 11:
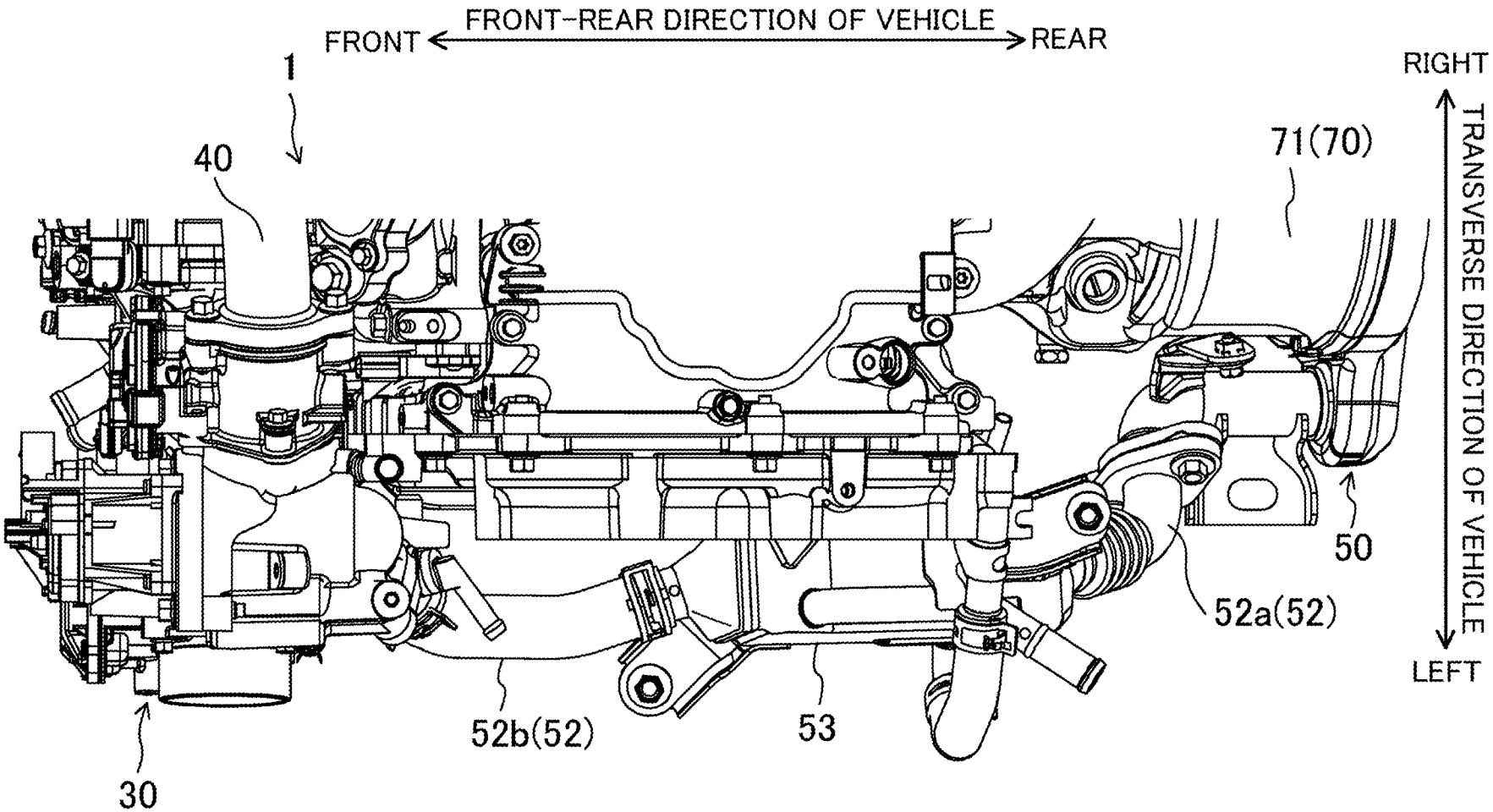
FIG. 11 is a top view of the EGR passage.
Figure 12:
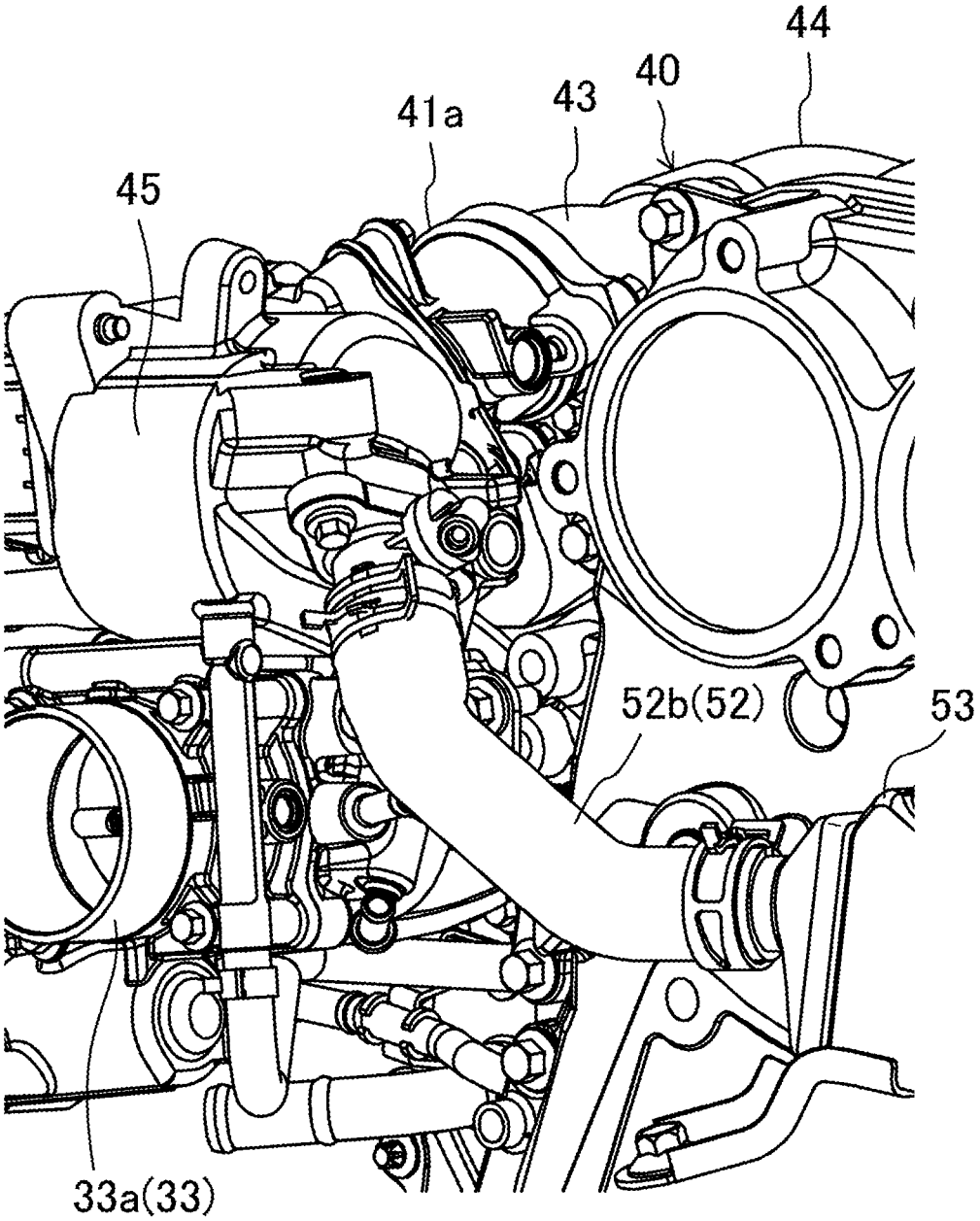
FIG. 12 is an oblique rear view of a downstream end of the EGR passage.
Figure 13:
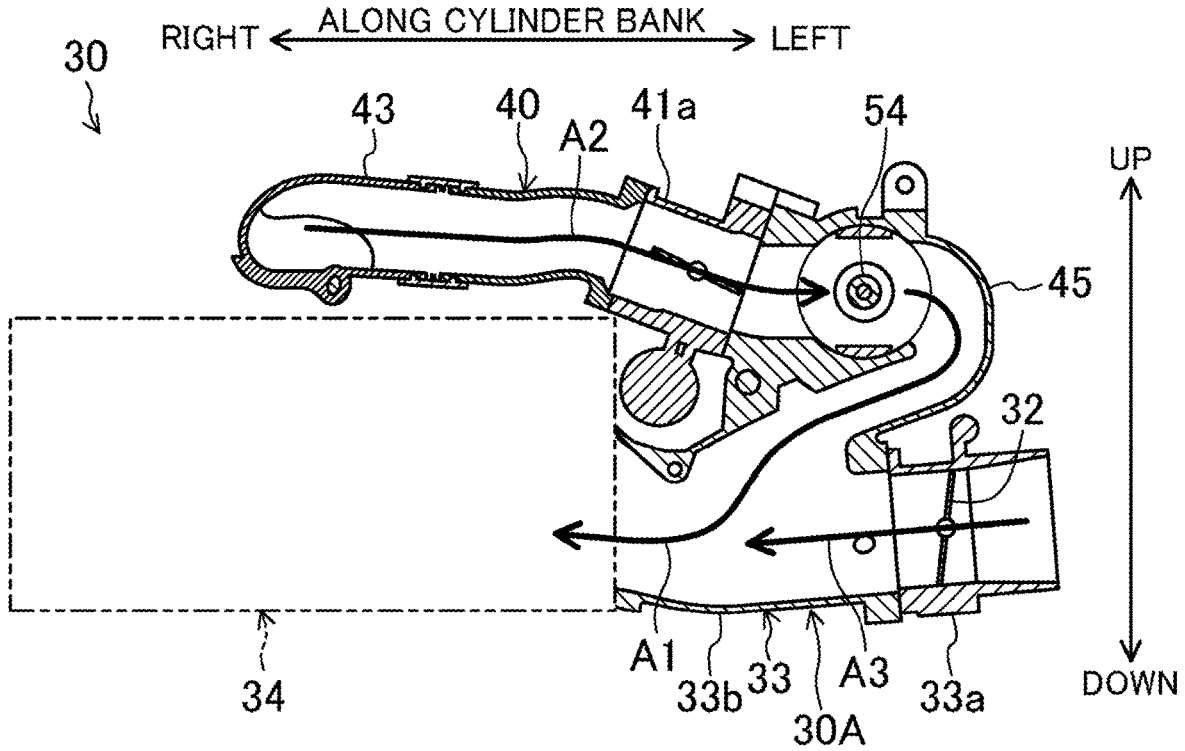
FIG. 13 illustrates a comparison between the flow of EGR gas in an intake passage during supercharging and during natural aspiration.
Figure 13:
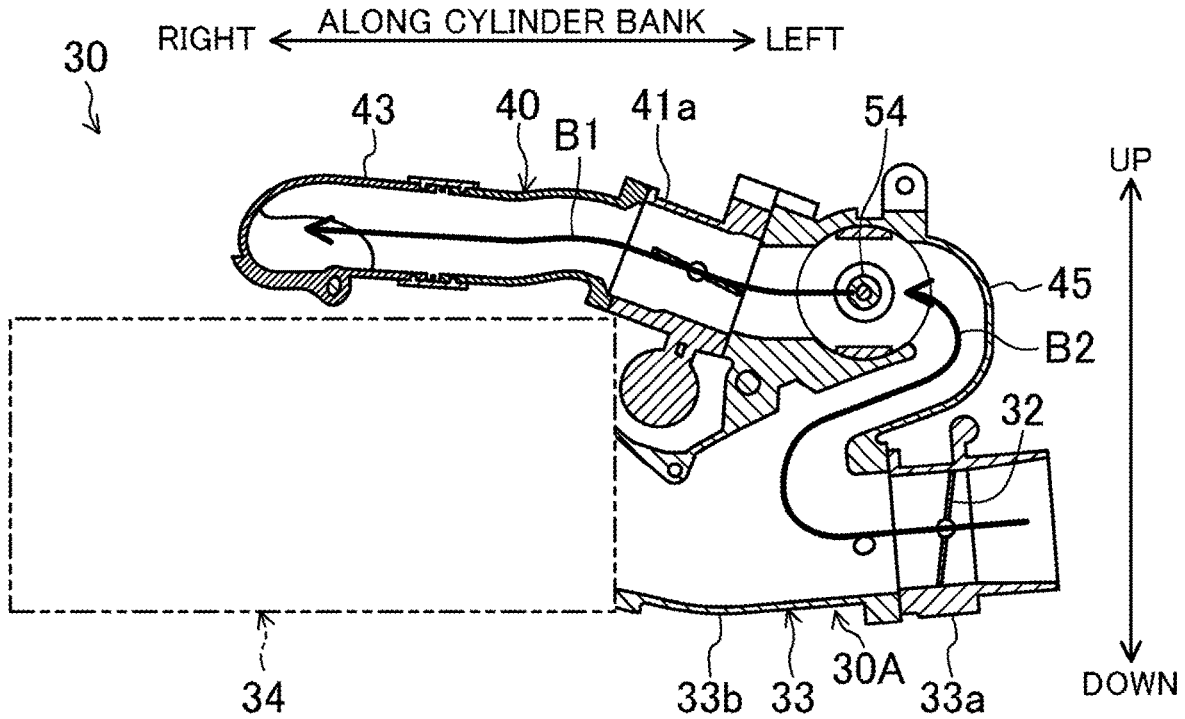

FIG. 10 is a left view of the EGR passage 52. FIG. 11 is a top view of the EGR passage 52. FIG. 12 is an oblique rear view of a downstream end of the EGR passage 52. FIG. 13 illustrates a comparison between the flow of the EGR gas in the intake passage 30 during supercharging and during natural aspiration.

As shown in FIG. 10, the EGR passage 52 branches off from the exhaust passage 50 including the catalyst converter 51. The downstream end of the EGR passage 52 is connected to the intake passage 30. Specifically, the EGR passage 52 branches off downstream of the catalyst converter 51 in the exhaust passage 50, and is connected upstream (specifically to the curving pipe 45) of the bypass valve 41 in the bypass passage 40 (also see FIG. 1).

As described above, the EGR passage 52 includes an EGR cooler 53 to cool the gas passing through the EGR passage 52. Hereinafter, in the EGR passage 52, a connection between the exhaust passage 50 and the EGR cooler 53 is referred to as an upstream EGR passage 52*a*; whereas, a connection between the EGR cooler 53 and the bypass passage 40 is referred to as a downstream EGR passage 52*b*.

Specifically, as shown in FIGS. 10 to 12, the upstream EGR passage 52*a* extends obliquely upward and forward along a left part of the exhaust passage 50. Then, the upstream EGR passage 52*a* turns left not to interfere with a left part of the engine body 10. Then, the upstream EGR passage 52*a* extends obliquely upward and forward again to reach the EGR cooler 53. As already described, the upstream end of the upstream EGR passage 52*a* is connected to the downstream end of the catalyst converter 51 in the exhaust passage 50, while the downstream end (front end) of the upstream EGR passage 52*a* is connected to an upstream end (rear end) of the EGR cooler 53.

The EGR cooler 53 is in the shape of a square tube at a slight angle from the front-rear direction. As shown in FIG. 10, at least in the state in which the engine 1 is mounted in the vehicle, the EGR cooler 53 is at substantially the same position as the intake ports 18 in the vertical direction with openings at both ends obliquely facing the respective front and rear sides. The upstream end of the EGR cooler 53 is directed obliquely downward and backward. As described before, the downstream end of the upstream EGR passage 52*a* is connected to the upstream end of the EGR cooler 53. Meanwhile, the downstream end (front end) of the EGR cooler 53 is directed obliquely upward and forward, and is connected to the upstream end (rear end) of the downstream EGR passage 52*b*.

The downstream EGR passage 52*b* extends upward from below from the upstream end to the downstream end along the gas flow. Specifically, as shown in FIGS. 10 to 12, the downstream EGR passage 52*b* extends obliquely upward and forward along the left part of the engine body 10 and turns substantially forward.

Then, the downstream end of the downstream EGR passage 52*b* extends substantially forward and is connected from behind to the curving pipe 45 of the bypass passage 40. This downstream end is opened and closed by the EGR valve 54. Although not shown in the drawing, the downstream end of the downstream EGR passage 52*b* is located above the intake ports 18 (particularly, the upstream ends of the intake ports 18).

Along with the combustion of the air-fuel mixture, the burnt gas exhausted from the combustion chamber 16 to the exhaust passage 50 passes through the catalyst converter 51. Then, part of the burnt gas passed through the catalyst converter 51 is introduced into the EGR passage 52. The burnt gas introduced into the EGR passage 52 sequentially passes through the upstream EGR passage 52*a*, the EGR cooler 53, and the downstream EGR passage 52*b* and is introduced into the bypass passage 40 as the external EGR gas. The amount of the external EGR gas to be introduced is adjusted by the degree of opening of the EGR valve 54.

In natural aspiration, the external EGR gas that has flowed into the bypass passage 40 joins the fresh air that has passed through the throttle valve 32 and flowed into the bypass passage 40 from the first passage body 33*b* (see the arrow B2 of the lower view of FIG. 13). As indicated by the arrow B1 of FIG. 13, the external EGR gas then flows through the bypass passage 40 from the upstream end to the downstream end. The external EGR gas that has joined the fresh air flows into the surge tank 38, sequentially passes through the independent passage 39 and the intake ports 18 and reaches the combustion chamber 16.

On the other hand, in supercharging, as indicated by the arrow A1 of FIG. 13, the external EGR gas that has flowed into the bypass passage 40 joins the gas that has flowed back from the surge tank 38 to the bypass passage 40 (see the arrow A2) and flows back through the bypass passage 40 from the downstream end to the upstream end. The gas that has flowed back into the first passage body 33*b* passes through the throttle valve 32, joins the fresh air that has flowed into the first passage body 33*b* (see the arrow A3), and is sucked into the supercharger 34.

(Downsized Configuration of Intake System)

As shown in FIG. 8, the EGR valve 54 may be located in the bypass passage 40. Here, the EGR valve 54 may be attached to, for example, the joint passage section 40A described above. However, if the valve is attached to the joint passage section 40A, condensed water caused by moisture contained in the external EGR gas may flow down to the first passage 33. If the condensed water, which is in general burned in the combustion chamber 16, flows down to the first passage 33 and is allowed to pass through the first passage 33, the condensed water will inevitably have to pass through the supercharger 34 and the intercooler 36, which is not desirable in terms of adhesion of moisture to the supercharger 34. On the other hand, reintroduction of the condensed water that has flowed down to the first passage 33 into the bypass passage 40 is disadvantageous in smoothly guiding the condensed water because of the positional energy required to lift up the condensed water.

To address the problem, the EGR valve 54 may be located not in the joint passage section 40A but in the parallel passage section 40B extending substantially straight toward the right. Such a configuration is advantageous in smoothly guiding condensed water from the parallel passage section 40B through the surge tank 38 to the combustion chamber 16 particularly in natural aspiration. In recent years, an as close as possible arrangement of the throttle valve 32 and the EGR valve 54 has been required in view of downsizing such the engine 1.

By contrast, in this engine 1, the bypass passage 40 extends once from the branch 33*d* to the left along the cylinder bank and then turns back and extends from the left to the right as shown in FIG. 8. In this configuration, as indicated by the section I, a part of the parallel passage section 40B overlapping the joint passage section 40A is closer to the throttle valve 32 along the cylinder bank. The placement of the EGR valve 54 in this part allows a close arrangement between the EGR valve 54 and the throttle valve 32 along the cylinder bank, while arranging the EGR valve 54 in the parallel passage section 40B.

As shown in FIG. 8, the branch 33*d* and the EGR valve 54 are located between the throttle valve 32 and the left end of the supercharger 34 along the cylinder bank.

In placement of the supercharger 34, an as short as possible flow path is required from the throttle valve 32 to the suction port (i.e., the left end) of the supercharger 34 to improve the responsiveness of the gas. In order to satisfy such a demand, the layout of the intake system needs to be devised to arrange the supercharger 34 and the throttle valve 32 closer to each other. To achieve such a configuration, it is required to reduce the interference between the EGR valve 54 and the supercharger 34.

As described above, the EGR valve 54 is located between the throttle valve 32 and the supercharger 34 along the cylinder bank. This arrangement is advantageous in preventing the interference between the EGR valve 54 and the supercharger 34.

That is, as shown in FIG. 8, the throttle valve 32 and the EGR valve 54 can be arranged as close as possible. This reduces the interference between the supercharger 34 and the EGR valve 54 in arranging the throttle valve 32 and the supercharger 34 close to each other. Accordingly, the flow path from the throttle valve 32 to the supercharger 34 becomes shorter, which leads to an improvement in the responsiveness of the gas.

As shown in FIG. 8, the EGR valve 54 is located at the left end of the parallel passage section 40B. If the external EGR gas is utilized, an as short as possible length of the flow path is required from the throttle valve 32 to the EGR valve 54 to improve the responsiveness of the gas.

By contrast, the configuration shown in FIG. 8 allows an as close as possible arrangement between the throttle valve 32 and the EGR valve 54. This provides an as short as possible flow path from the throttle valve 32 to the EGR valve 54, which leads to an improvement in the responsiveness of the gas.

As shown in FIG. 8, the part of the curving pipe 45 serving as the joint passage section 40A has a diameter gradually increasing with a decreasing distance to the lower right. Such a configuration is advantageous in increasing the opening area of the branch 33*d*. This allows the gas to flow smoothly through the branch 33*d*.

As shown in FIG. 8, the EGR valve 54 is located so as to be adjacent to and toward the left of the throttle valve 32 along the cylinder bank. Such an arrangement provides a space for arranging the bypass valve 41 between the EGR valve 54 and the supercharger 34 as shown in the figure. This configuration achieves integration of the throttle valve 32, the bypass valve 41, and the EGR valve 54, which leads to downsizing of the engine 1.

Other Embodiments

While an example has been described in the embodiments above where the EGR valve 54 serves as the second valve, the present disclosure is not limited to the configuration. For example, the bypass valve 41 may serve as a second valve. Such a configuration allows integration of the bypass valve 41 and the throttle valve 32.

While an example has been described in the embodiments above where the bypass passage 40 is located above the main intake passage 30A, the present disclosure is not limited to the configuration. For example, the bypass passage 40 may be located in front of or below the main intake passage 30A.

DESCRIPTION OF REFERENCE CHARACTERS

1 Engine
16 Combustion Chamber
30 Intake Passage
30A Main Intake Passage (First Passage Section)
32 Throttle Valve
34 Supercharger
40 Bypass Passage (Second Passage Section)
40A Joint Passage Section
40B Parallel Passage Section
50 Exhaust Passage
52 EGR Passage
54 EGR Valve (Second Valve)

The invention claimed is:

1. An intake system for an engine, the system comprising:
an intake passage connected to a combustion chamber;
a throttle valve in the intake passage;
a supercharger provided in the intake passage; and
an EGR passage connected to: an exhaust passage connected to the combustion chamber; and the intake passage, wherein
the intake passage includes:
a first passage section provided with the throttle valve and extending from a first side to a second side along a predetermined direction; and
a second passage section provided with a specified second valve, the second passage section being connected to a part of the first passage section at a connecting point located on the second side with respect to the throttle valve,
the second passage section extends from the connecting point toward the first side and then turns back and extends from the first side toward the second side,
the second passage section is a bypass passage that branches off from the intake passage upstream of the supercharger and is connected to the intake passage downstream of the supercharger,
the EGR passage is connected to the second passage section, and the second valve serves as an EGR valve for adjusting a backflow rate of gas passing through the EGR passage,
the second passage section is provided with an air bypass valve for changing a cross-sectional flow area of the second passage section,
the second valve is located in a part of the second passage section extending from the first side toward the second side and overlapping, in the predetermined direction, with a part of the second passage section extending from the connecting point toward the first side as viewed from the predetermined direction, and
the second valve and the air bypass valve are disposed between the throttle valve and the supercharger in the predetermined direction when the intake passage is viewed from a front along an intake and exhaust direction orthogonal to the predetermined direction.

2. The intake system of claim 1, wherein
the second passage section includes:
a joint passage section connected to the first passage section and extending from the second side toward the first side with an increasing distance from the connecting point; and
a parallel passage section connected to an end of the joint passage section on the first side and extending toward the second side, and
the joint passage section is configured such that a center axis of the joint passage section is at acute angles from both a center axis of the first passage section and a center axis of the parallel passage section.

3. The intake system of claim 1, wherein
the supercharger is disposed downstream of the throttle valve in the first passage section, and
the connecting point between the first and second passage sections is located between the throttle valve and a gas suction port of the supercharger in the predetermined direction.

4. The intake system of claim 3, wherein
the second valve is located between the throttle valve and the supercharger in the predetermined direction.

5. The intake system of claim 1, wherein
the second valve is located at an end of the second passage section toward the first side.

6. The intake system of claim 1, wherein
the second passage section is located above the first passage section.

7. An intake system for an engine, the system comprising:
an intake passage connected to a combustion chamber;
a throttle valve and a supercharger in the intake passage; and
an EGR passage connected to: an exhaust passage connected to the combustion chamber; and the intake passage, wherein
the intake passage includes:
a first passage section provided with the throttle valve and extending from a first side toward a second side in a horizontal direction;
a second passage section branching off from downstream of the throttle valve in the first passage section, extending from the second side toward the first side, and then turning back and extending from the first side toward the second side; and
a predetermined second valve in the second passage section,
the second passage section is located above the first passage section in a vertical direction of a vehicle, and the second valve is located between the throttle valve and the supercharger in the horizontal direction,
a part of the second passage section extending from the second side toward the first side passes through a gap in the vertical direction between the first passage section and the second valve,
the second passage section is a bypass passage that branches off from the intake passage upstream of the supercharger and is connected to the intake passage downstream of the supercharger,
the EGR passage is connected to the second passage section, and the second valve serves as an EGR valve for adjusting a backflow rate of gas passing through the EGR passage,
the second passage section is provided with an air bypass valve for changing a cross-sectional flow area of the second passage section, and
the second valve and the air bypass valve are disposed between the throttle valve and the supercharger in the horizontal direction when the intake passage is viewed along an intake and exhaust direction that is orthogonal to the horizontal direction and that extends toward the exhaust passage from the intake port.

8. The intake system of claim 1, wherein
the second valve is located closer to the second side in the predetermined direction than the throttle valve,
the second valve is located higher in position than the throttle valve in a height direction of the engine orthogonal to the predetermined direction and the intake and exhaust direction,
the air bypass valve is located closer to the second side than the second valve and closer to the first side than a suction port for gas of the supercharger, in the predetermined direction, and
the air bypass valve is located higher in position than the suction port in the height direction.

9. The intake system of claim 7, wherein
the second valve is located closer to the second side in the horizontal direction than the throttle valve, the second valve is located higher in position than the throttle valve in a height direction of the engine orthogonal to the horizontal direction and the intake and exhaust direction, the air bypass valve is located closer to the second side than the second valve and closer to the first side than a suction port for gas of the supercharger, in the horizontal direction, and the air bypass valve is located higher in position than the suction port in the height direction.

10. The intake system of claim 1, wherein the second passage section includes sequentially from an upstream side along a flow direction:

a curving pipe extending from a branch, the branch branching off from the first passage section to the second passage section;

a valve body having the air bypass valve built therein;

a straight pipe extending toward the second side along the predetermined direction; and a branch pipe that branches into two to be connected to a surge tank.

11. The intake system of claim 7, wherein the second passage section includes sequentially from an upstream side along a flow direction:

a curving pipe extending from a branch, the branch branching off from the first passage section to the second passage section;

a valve body having the air bypass valve built therein;

a straight pipe extending toward the second side along the horizontal direction; and a branch pipe that branches into two to be connected to a surge tank.

12. The intake system of claim 1, wherein the second passage section comprises:

a joint passage section extending obliquely with respect to the first passage section so as to head from the first side to the second side in the predetermined direction with an increasing distance from the connecting point along a height direction of the engine orthogonal to the predetermined direction and the intake and exhaust direction; and a parallel passage section connected to an end of the joint passage section on the second side and extending toward the first side, and the joint passage section is configured such that a center axis of the joint passage section forms acute angles with both a center axis of the first passage section and a center axis of the parallel passage section.

13. The intake system of claim 7, wherein the second passage section comprises:

a joint passage section extending obliquely with respect to the first passage section so as to head from the first side to the second side in the horizontal direction with an increasing distance from the connecting point along a height direction of the engine orthogonal to the horizontal direction and the intake and exhaust direction; and a parallel passage section connected to an end of the joint passage section on the second side and extending toward the first side, and the joint passage section is configured such that a center axis of the joint passage section forms acute angles with both a center axis of the first passage section and a center axis of the parallel passage section.

14. The intake system of claim 10, wherein the EGR passage is connected to the curving pipe of the second passage section.

15. The intake system of claim 11, wherein the EGR passage is connected to the curving pipe of the second passage section.

16. The intake system of claim 1, wherein the second valve and the air bypass valve are arranged next to each other along the predetermined direction.

17. The intake system of claim 12, wherein the second valve and the air bypass valve are arranged next to each other along the predetermined direction.

* * * * *